US005972206A

United States Patent [19]

Lenglet et al.

[11] Patent Number: 5,972,206

[45] Date of Patent: Oct. 26, 1999

[54] FLEXIBLE STEAM CRACKING PROCESS AND CORRESPONDING STEAM CRACKING FACILITY

[75] Inventors: Eric Lenglet, 36 Elysée 2, 78170 La Celle Saint Cloud; Paul Broutin, Chaponost; Jean-Pierre Burzynski, Sainte-Foy-Les Lyon; Hervé Cazor, Vienne; Roland Huin, Montesson la Borde, all of France

[73] Assignees: Institut Francais du Petrole; Procedes Petroliers et Petrochimiques; Eric Lenglet, all of, France

[21] Appl. No.: 08/860,249

[22] PCT Filed: Dec. 22, 1995

[86] PCT No.: PCT/FR95/01717

§ 371 Date: Jun. 25, 1997

§ 102(e) Date: Jun. 25, 1997

[87] PCT Pub. No.: WO96/20255

PCT Pub. Date: Jul. 4, 1996

[30] Foreign Application Priority Data

Dec. 26, 1994 [FR] France ..... 94 15743

[51] Int. Cl.[6] ..... C10G 9/36; C10G 9/28; F28D 7/00; F28D 21/00

[52] U.S. Cl. ..... 208/130; 208/126; 208/48 R; 208/48 AA; 585/648; 585/652; 585/950; 422/200; 422/201; 422/202; 422/207; 422/213; 422/217; 134/22.11

[58] Field of Search ..... 208/48 R, 48 AA, 208/126, 130; 585/648, 652, 950; 422/200, 201, 202, 207, 213, 217; 110/216; 134/22.11

[56] References Cited

U.S. PATENT DOCUMENTS

| | | | |
|---|---|---|---|
| 4,420,343 | 12/1983 | Sliwka | 134/22.15 |
| 5,177,292 | 1/1993 | Lenglet | 585/648 |
| 5,183,642 | 2/1993 | Lenglet | 422/213 |
| 5,186,815 | 2/1993 | Lenglet | 208/48 R |

FOREIGN PATENT DOCUMENTS

| | | |
|---|---|---|
| 00361651 | 9/1981 | European Pat. Off. . |
| 9212851 | 11/1990 | WIPO . |

*Primary Examiner*—Walter D. Griffin
*Attorney, Agent, or Firm*—Miller, White, Zelano, & Branigan, P.C.

[57] ABSTRACT

A flexible steam cracking process for hydrocarbon feeds comprises injection of particles with an average size of between 0.02 mm and 4 mm, at a circulation rate in indirect transfer line exchangers (4) of 20 to 180 m/s, and in a sufficient quantity to limit the increase in temperature at the outlet to the exchangers (4) to a value of less than 100° C. per month, into at least one point upstream of an indirect transfer line exchanger (4), cracking zone (2) remaining in communication with downstream means (6) for the treatment of cooled effluents. At least 70% by weight of the quantity of injected particles is introduced between the outlet to the cracking zone (2) and the tubes of the indirect transfer line exchanger (4). Chemical decoking is carried out in the tubes of the cracking zone at time intervals of less than 4 months by establishing accelerated coke gasification conditions, for example by injecting compounds which catalyse gasification by steam, or by decoking in air and/or steam.

41 Claims, 2 Drawing Sheets

FLEXIBLE STEAM CRACKING PROCESS AND CORRESPONDING STEAM CRACKING FACILITY

FIELD OF THE INVENTION

The invention concerns a flexible process for the steam cracking of hydrocarbons, i.e., a process which can handle a wide variety of feeds to be cracked.

BACKGROUND OF THE INVENTION

The prior art is illustrated in International patent application WO-A-90 12851 and European patent application EP-A-0 036 151.

Steam cracking is a basic process in the petrochemicals industry and consists of high temperature cracking then rapidly cooling a feed of hydrocarbons and steam. The principal operating problem arises from the deposition of carbon-containing substances on the internal walls of the facility. These deposits, constituted by coke or condensed, heavy pyrolysis tar, which is coagulated to a greater or lesser extent, limits heat transfer in the cracking zone (coils of pyrolysis tubes) and the indirect cooling zone (effluent transfer line exchanger), requiring frequent stoppages in order to decoke the facility.

Conventional cycle times (between two complete chemical decoking steps in the cracking zone, in air and/or steam) are either fixed (controlled stoppages) or variable depending on the coking in the facility, and are generally between 3 weeks and 12 weeks for feeds such as naphtha and liquefied petroleum gas.

The skilled person is aware that coking problems encountered when cracking heavy feeds (atmospheric gas oils, heavy gas oils, vacuum distillates) are far more severe than those encountered with conventional feeds such as naphtha.

As a consequence, these feeds cannot be cracked in conventional steam crackers designed for cracking naphtha, and they can only be cracked in existing processes in special furnaces typically comprising direct cooling (with pyrolysis oil) of the steam cracking effluents, which is considerably deleterious to the energy balance in the facility (no production of high pressure steam).

Known processes which are flexible as regards heavy feeds are thus incompatible with existing steam cracking facilities for conventional feeds and have a much worse energy balance.

We have proposed (EP-A-0 419 643, EP-A-0 425 633 and EP-A-0 447 527) a decoking process for use during the operation of steam cracking facilities by injection of solid erosive particles, to overcome coking problems and obtain continuous or substantially continuous steam cracking (for example with cycle periods of the order of one year).

For a particular feed, this process consists in allowing a layer of coke to form and age on the internal walls of the cracking coil, then injecting erosive particles (for example hard mineral particles with a diameter of less than 150 micrometers, which may be spherical or angular) in a sufficient quantity to substantially stabilise coking of the tubes without totally eliminating the precoat of coke which protects the tubes.

This process requires a good knowledge of the coking rates in the feed under consideration and a coil design which provides a certain amount of correspondence between the local coking rates connected to the progress of cracking along the coil and the erosion intensity connected to the rate profile along the coil and to the nature of the erosive particles. By means of simulations of coking rates and the circulation rate profile in the coil, and by means of pilot experiments, it is possible to produce substantially continuous steam cracking conditions in the feed under consideration.

Tube erosion can be maintained at a very low or zero level, and controlled by analysis of the trace metals (iron, chromium, nickel) in the recovered powder.

We have thus sought to perfect this process, which can be applied to cracking a particular feed, to a flexible furnace for the successive treatment of a large number of different feeds, under differing operating conditions (flow rate, dilution, cracking severity).

Pilot tests have been carried out and have produced several unexpected results:

Initial coking in the coil (at the beginning of the cycle) can vary very widely depending on the feed, even for feeds which only have slightly different compositions but are from different sources.

This cannot be fully explained, but may result from the presence of impurities in the feed.

Decoking efficiency has been shown to depend mainly on the feeds and operating conditions (different nature of coke). In particular, it has been found that light feeds: $C_3$, $C_4$, light naphtha, produce a catalytic coke at the beginning of the reaction zone which is much more fragile (5 to 10 times) than the asymptotic coke which predominates in the middle and at the end of the reaction zone. For these feeds, then it is desirable to limit the circulation rate in this zone to maintain the protective coke layer and/or avoid the risk of erosion of the cracking tubes.

Thus it has not been possible to predetermine the quantities of particles suitable for each feed and each operating condition without preliminary tests, which are impossible to carry out in the case of a flexible industrial furnace. Further, the geometry of the cracking reactor adapted for a given feed, as regards preventing erosion risks, is not the same as that adapted for another feed with a different dilution and different nature of coke (in which the circulation rate profile will be different).

Finally, because of the difficulties in obtaining reliable and precise measurements of the skin temperatures in the tubes by optical pyrometry, and the fluctuations in these temperatures and the pressure drop under varying operating conditions, it is very difficult to efficiently monitor coking in the tube without frequently reference to a constant reference state; this is not possible for a flexible industrial furnace and thus the coking state in a pyrolysis coil cannot be controlled in real time.

The process is thus difficult to carry out industrially under variable operating conditions, and it has not been possible to prevent all traces of erosion in the cracking tubes in the pilot tests.

It has thus become clear that the continuous steam cracking process cannot be adapted for a flexible furnace and must be reserved for cracking identical or near-identical feeds which are cracked under relatively stable conditions.

We have also shown that deposits in the transfer line exchanger can be eliminated far more easily than from the pyrolysis tubes and that, even in the case where an excess of particles is injected, no erosion occurs.

It has surprisingly become clear that carbon-containing deposits in the transfer line exchanger, in particular in the case of heavy feeds, are far more fragile than the coke in the cracking tubes. We have found that the fragility as regards erosion by the solid particles tested is at least 25 times greater for the coke in the transfer line exchanger than for the asymptotic coke in the pyrolysis tubes. The absence of erosion observed in the exchanger tubes themselves is explained by the fact that the circulation rate of the particles is much lower in the transfer line exchanger than in the pyrolysis tubes, and their temperature is very low (330° C. as opposed to a typical value of 1000° C. to 1100° C. for the pyrolysis coil). Further, the transfer line exchanger tubes are straight, with no turns, which overcomes the risk of point erosion.

It has also become clear that over long periods, the coking rates in the cracking tubes remain of the same order of magnitude for heavy feeds (gas oil, for example) as for those of light feeds, and that the real obstacle to flexibility as regards heavy feeds resides in excessive fouling of the transfer line exchanger. Thus we have found, in a non obvious fashion, that existing naphtha steam cracking facilities can also be used to crack heavy feeds such as gas oils and vacuum distillates of the right quality, if rapid fouling of the transfer line exchangers can be prevented.

We are thus proposing a novel process for flexible steam cracking which is compatible with existing steam cracking facilities and which can treat a variety of feeds under various operating conditions, and without deteriorating the heat balance of the facilities, without notable risks of erosion and with moderate investment costs.

SUMMARY OF THE INVENTION

Figure 1:
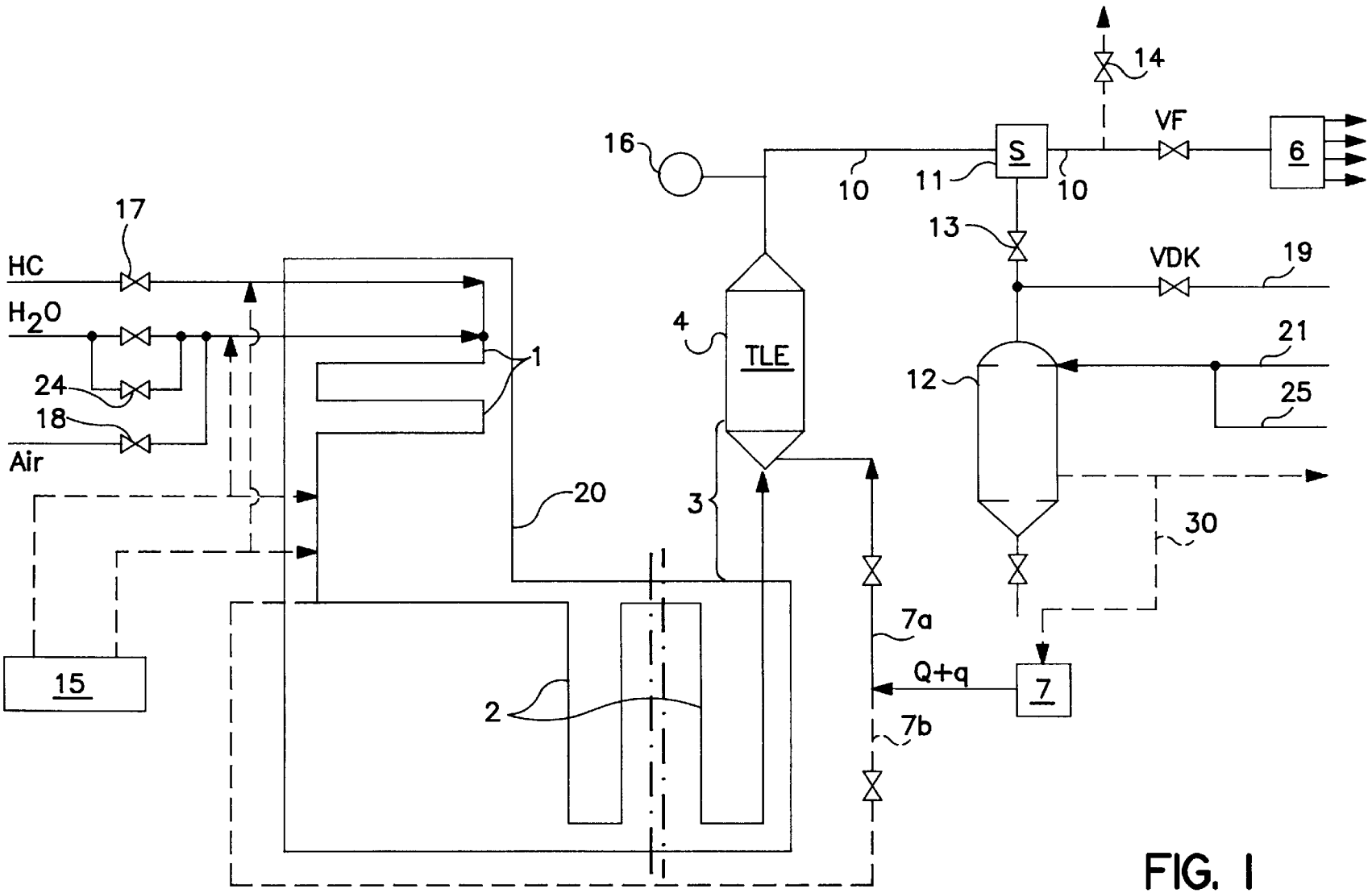
FIG. 1 schematically shows a steam cracking facility of the invention comprising a plurality of devices relating to different variations of the invention.

The invention thus provides a process for steam cracking hydrocarbon feeds in a steam cracking facility comprising at least one steam cracking furnace which comprises, referring for example to FIG. 1, at least one cracking zone (2) containing pyrolysis tubes, connected via a transfer zone (3) to indirect cooling means (4) for the effluents from that cracking zone (2), for example a transfer line exchanger (TLE), and downstream means for the treatment of the cooled effluents, the process comprising injection of solid erosive particles upstream of the indirect cooling means (4) to eliminate at least a portion of the carbon-containing deposits located on the internal walls of the facility, the cracking zone remaining in communication with the downstream means (6) during the particle injection phases, the process being characterized in that:

a) during a steam cracking cycle, solid erosive particles are injected with a diameter in the range 0.02 mm to 4 mm, into at least one point in the transfer zone (3), the particles then circulating in the indirect cooling means, transported by a carrier gas at an average velocity in the range 20 to 180 m/s, the average amount, $\overline{Q}$, of particles injected into said transfer zone during a steam cracking cycle being at least 0.7 times the overall average amount, $[\overline{Q}+\overline{q}]$, with respect to the cracked gases, of particles injected upstream of the indirect cooling means (4) during the same steam cracking cycle, $\overline{q}$ being the average amount of particles introduced into and/or upstream of said cracking zone;

the overall average amount, $[\overline{Q}+\overline{q}]$ of injected particles being set so as to limit the temperature increase at the outlet from the indirect cooling means (4) to a value of less than 100° C. per month, preferably less than 50° C. per month;

b) in the cracking zone (2), either continuously or discontinuously at intervals not exceeding 4 months, preferably not exceeding 3 months, establishing accelerated coke gasification conditions to maintain the operation of the cracking zone.

A steam cracking cycle is generally defined as a period of operation of a furnace (or zone of a furnace) between two consecutive stoppages of long duration for decoking. Between these two stoppages of long duration, the furnace operates under normal steam cracking conditions. Here we shall use a slightly more general definition: a steam cracking cycle (in a furnace zone, or in the whole furnace) is considered to be an operating period between two consecutive stoppages in the cracking operation of long duration, by definition of a duration of more than two hours, during which the furnace (or furnace portion) remains connected to the downstream sections for the treatment of cracked gases.

During this cycle, the furnace (or furnace zone) thus operates under steam cracking conditions, optionally with short periods (less than two hours, generally less than 0.5 hours) during which only steam is supplied without disconnecting the downstream sections.

The average amount $\overline{Q}$ of particles injected into the transfer zone is defined as:

$$\overline{Q} = \frac{\text{Cumulative quantity } Q \text{ of particles injected into transfer zone}}{\text{cumulative quantity of cracked gases}}$$

These cumulative quantities are for the period corresponding to a steam cracking cycle. The cracked gases correspond to hydrocarbons plus diluting steam.

There is an analogous definition for $\overline{q}$, the average amount of particles not introduced into the transfer zone, but further upstream: into the cracking zone and/or upstream of the cracking zone.

The average overall amount of particles injected upstream of the indirect cooling means (transfer line exchanger) is thus the sum of these two amounts, namely: $\overline{Q}+\overline{q}$.

In accordance with the invention, we have: $\overline{Q} \geqq 0.7(\overline{Q}+\overline{q})$. Thus the majority of the solid erosive particles (minimum 70%) or the totality is injected downstream of the cracking zone (pyrolysis tubes) into the transfer zone towards the transfer line exchanger (generally termed TLE or TLX).

If [Q+q] is the cumulative quantity of erosive particles injected during a steam cracking cycle, with quantity Q being injected into the transfer zone, and with quantity q being injected into or upstream of the cracking zone, solid particles circulate in the two zones as follows:

cracking zone (or at least its terminal portion, the most "coking"): average quantity q of erosive particles;

indirect cooling zone (TLE tubes): quantity of particles [q+Q].

Since the cracking zone is located upstream of the indirect cooling zone, all the particles injected into or upstream of this zone also circulate in the TLEs, which are located downstream.

Thus in accordance with the invention, far more solid particles (more than 3 times more) circulate in the transfer line exchanger than in the pyrolysis tubes. Now, decoking the pyrolysis tubes is far more difficult to carry out (the coke is far less fragile) and would require a far larger quantity of particles than would the transfer line exchanger: more than 25 times more under the same circulating conditions for the erosive particles, and in fact 4 to 12 times more, when the fact that the circulation rates are higher in the pyrolysis tubes than in the TLE tubes is taken into account.

The process thus does not aim to decoke both the cracking tubes and the transfer line exchanger tubes at the same time by erosion, in contrast to the prior art process for a non flexible furnace: this prior art philosophy would in effect involve the injection of a maximum number of particles, thus the totality of the particles, into the pyrolysis tubes, i.e., Q=0 (thus, Q+q=q and $\overline{Q}+\overline{q}=\overline{q}$).

In contrast, the process of the invention provides a quantity of particles Q+q adapted to control fouling in the TLEs, the quantity q being highly insufficient to carry out erosive decoking of the pyrolysis tubes. This decoking is thus mainly carried out by chemical gasification means.

Thus erosive decoking which predominates in the TLE tubes is combined with chemical decoking (gasification) predominantly in the pyrolysis tubes with excellent reliability in the overall process: the primary aim of this novel process is to ensure feed flexibility without risking erosion in the facility. This process is compatible with existing naphtha steam cracking processes, and is energetically superior to a conventional process for cracking heavy feeds in special furnaces with direct cooling, which does not produce high pressure steam.

In addition, the quantity of particles circulating in the pyrolysis tubes is limited to a level at which the pyrolysis tube bank does not need to be modified: the facility of the invention is thus far less costly than the prior art process carrying out erosive decoking in the pyrolysis tubes which necessitates reinforcing and thus replacing all the turns. It is even possible not to circulate the particles in the pyrolysis tubes ($\overline{q}$=q=0) and decoke them exclusively chemically.

The "erosive decoking" part of the process works because coking is limited to an obstruction, i.e., the indirect cooling means, which are in a zone with a low circulation rate and relatively cold, where the metal is typically at less than 400° C., considerably limiting the risk of erosion. Further, control of the process and the quantities of particles injected is considerably facilitated since the temperature at the outlet of the transfer line exchanger can be reliably measured and provides a precise indication of the degree of fouling. This is not the case for the skin temperatures of the pyrolysis tubes which is more difficult to measure, and influenced by the flexible operating conditions which in effect force a "blind" decoking step in the process in which erosive decoking of the pyrolysis tubes is complete under flexible conditions.

This process thus means that heavy feeds can be treated in a steam cracking facility designed for the cracking of naphtha, and the feeds can be changed frequently depending on the spot prices of the feeds. The cracking severity can also be varied without risking damage to the facility.

This flexibility is achieved without deterioration in the energy balance since the transfer line exchangers are retained: it is thus possible to cool the cracked gases to 500° C. and even to a temperature of less than or equal to 450° C., including heavy feeds such as kerosine, gas oil, or vacuum distillate; this is not possible in the known process for steam cracking these feeds in special furnaces comprising either special TLEs where the cooling of the gases is limited to a typical value of 600° C., or generally direct cooling which means that there is no high degree of heat recovery.

Advantageously, particle injection can be set so that the increase in the outlet temperature T from the indirect cooling means is less than 50° C. per month, for example in the range 5° C. to 50° C. per month, in particular in the range 10° C. to 40° C. per month, preferably less than 30° C. per month during a steam cracking cycle.

In a further variation of the invention, a sufficient total quantity of particles, i.e., a sufficient overall average amount [$\overline{Q}+\overline{q}$], is injected to substantially stabilise the temperature at the outlet of the transfer line exchanger (TLE) during a steam cracking cycle.

This can be carried out by modulating the injection frequency and/or the quantity of particles introduced during an injection step.

In one implementation of the invention, only a small, or a zero, quantity of particles is injected into the cracking zone or upstream thereof. This means that the risks of erosion in this zone are removed and the thickness of the coke is allowed to increase in this zone without notable erosion even in the case where, for some feeds, a protective layer of coke cannot of be maintained at some points in the tube bank.

It is thus generally recommended that the average amount $\overline{q}$ of particles injected during a steam cracking cycle upstream and/or into the cracking zone is severely limited to an average value of less than 200 ppm, preferably less than 100 ppm with respect to the cracked gases. Further, it is preferable to limit the average amount of angular substantially non porous mineral particles (the most aggressive particles as regards erosive efficiency) to less than 60 ppm, preferably less than 30 ppm with respect to the cracked gases.

If the values required for complete elimination of the coke from the pyrolysis tubes is approached, according to tests carried out in the prior art typically between 2000 and 8000 ppm of angular mineral particles with respect to the cracked gases, it can be established that the predominant mode of decoking of the pyrolysis tubes is by chemical gasification and not erosion.

A limited quantity of particles can, however, be usefully injected into the pyrolysis tubes, more particularly at the beginning of the steam cracking cycle, to eliminate a substantial portion of the filamentous catalytic coke formed at the beginning of a cycle, which is far more fragile. Preferably, at least 50% of the quantity q of particles circulating in the pyrolysis tubes during a steam cracking cycle is injected over the first 72 hours of the cycle.

In a further variation of the invention, the totality of the erosive particles injected upstream of the indirect cooling means is injected into the transfer zone.

This variation, which corresponds to $\overline{q}$=0, may be preferable when the steam cracking facility has a supplementary furnace which can maintain production when one of the furnace is decoking (this is frequently the case).

It is difficult to precisely define the quantities of particles necessary to keep the fouling in the transfer line exchanger to a low level, or zero: the erosive efficiency greatly depends of the circulation rate of the particles in the exchanger which varies depending of the type of exchanger and the facilities, and also on the quantity of coke deposited, and its fragility which greatly depends on the feeds used, any impurities (for example traces of asphaltenes or heavy aromatics such as ovalene, or coronene for certain hydrotreated distillates), also on the operating conditions (cracking severity, dilution).

This imprecision in the quantity of particles necessary does not present a problem since measurement of the temperature at the outlet to the cooling means, even under flexible conditions, means that the process can be reliably controlled.

In general, during a steam cracking cycle the average amounts [$\overline{Q}+\overline{q}$] of particles injected upstream of the indirect cooling means (TLE exchanger) are in the range 20 to 1500 ppm, in particular in the range 50 to 800 ppm with respect to the cracked gases. If less aggressive particles are used for certain feeds, larger quantities can be injected, up to 3000 ppm, for example.

The process is very easy to control, since fouling in a cooling means can be recognised simply by measuring the outlet temperature of effluents from the exchanger: this can show whether the quantity of injected particles is sufficient or it must be increased or reduced.

The particles can be continuously injected, but the flow rates are then very low, making control of the flow rates difficult.

Preferably, the particles are injected discontinuously, sequentially, which means that the same injection apparatus can be used for several transfer line exchangers or several furnaces, by successively supplying the particles to different injection points in the facility.

The erosive particles are preferably injected sequentially at fixed intervals or at intervals varying between 0.3 and 72 hours, preferably between 1 and 20 hours (for each transfer line exchanger).

Injections may be made at regular intervals, for example by modifying the quantity of injected particles to obtain the desired effect of controlling fouling of the transfer line exchanger.

It is also possible to inject the particles (for example in constant quantities) when the temperature of the indirect cooling means (TLE exchangers) exceeds a predetermined value.

The average amount of particles with respect to the cracked gas, i.e., the ratio:

$$\overline{Q} + \overline{q} = \frac{\text{total weight of injected particles}}{\text{total weight of cracked gases}}$$

during a steam cracking cycle is generally in the range 0.00002 to 0.0015 (corresponding to the interval described already, 20 to 1500 ppm); in contrast, the instantaneous amount of solid particles during one injection step (typically carried out discontinuously during normal operation of the steam cracker) will be much higher, typically in the range 0.5% to 20% by weight, preferably in the range 1% to 10% by weight with respect to the cracked gases.

The particles used in the process of the invention mainly comprise two categories of solid particles:

In a first variation of the process, solid mineral particles are used which are substantially non porous, constituted by silicon carbide, or simple or mixed oxides of silicon, aluminium and zirconium.

These particles are highly resistant to wear and, if they comprise at least a fraction of angular particles, they are highly effective in eliminating coke. If mineral particles are used, they must be recovered, for example in a cyclone downstream of the transfer line exchanger, so that they do not pollute the downstream sections for treating the cracked gases and pyrolysis oil, generally sold as a fuel.

In a second variation, coke particles can be used: oil coke, obtained by a fluid or chamber process, metallurgical coke, or calcined anthracite, ground to the desired granulometry.

These particles are more sensitive to wear than the preceding particles; they are also less efficient at eliminating coke disposed on the walls of the transfer line exchanger. In contrast, they have the great advantage of being combustible, and their presence in pyrolysis oil, if in a concentration of no more than a few hundredths of a ppm in the oil, does not present major problems. Depending on the local conditions, and the use of the pyrolysis oil, coke particles can be injected, with simplified recovery at the transfer line exchanger outlet or without recovery. This latter is practically excluded when using mineral particles.

Particles containing at least 20% by weight of angular particles are used, for example a mixture of two different types of particles.

Preferably, before any final grinding to the desired granulometry and during their manufacturing process, the major portion of the coke particles injected are subjected to a temperature of at least 850° C. (for example calcining at a temperature of not less than 850° C.). These particles which are stabilised at 850° C. run a much smaller risk of shattering when introduced into the cracked gases at that temperature.

Injections of particles are generally carried out during operation of the facility under normal steam cracking conditions; the carrier gas for the particles in the tubes of the transfer line exchanger is thus the cracked gas stream.

When very heavy feeds such as vacuum distillates are cracked, and solid particles are injected discontinuously, for example into the transfer zone, separated and recovered downstream of these cooling means, a highly interesting variation of the process avoids any pollution of the recovered particles by condensation of tar. In this variation, the furnace feed is modified during the particle injection phase by substituting a lighter feed selected from the group formed by steam, hydrocarbons with a boiling point of less than 250° C. and mixtures thereof.

This modification to the feed means that the particles are transported by a vector gas composed of steam alone, or cracked gases from feeds such as naphtha, and avoids any condensation of heavy tars. This variation of the process can be used whenever pollution of the recovered particles would be a nuisance.

The feed is modified for short periods: for example, steam alone can be circulated for a period of less than two hours, preferably less than one hour and particularly 0.3 hours, this period including the period during which the particles are injected. These very brief interruptions to steam cracking, with the furnace remaining connected to the downstream sections and flushed with steam, does not greatly disturb the production from a facility comprising a number of furnaces. These very brief interruptions do not correspond to a new steam cracking cycle, as defined above, and one steam cracking cycle corresponds to continuous or substantially continuous hydrocarbon cracking, and may include very brief interruptions in cracking, of less than 2 hours in duration.

In accordance with the invention, the vector gas transporting the particles is thus either a mixture of hydrocarbons and steam (in the general case), or steam alone.

In a further implementation of the invention, coke particles are injected into the transfer zone, and at least a portion is not recovered before the outlet of the effluents from the furnace, and thus circulate to the downstream effluent treatment means. These non recovered coke particles act to eliminate residual deposits in the lines downstream of the transfer line exchanger. Pilot tests on a vacuum distillate have shown that the pressure drop in the line downstream of the transfer line exchanger unexpectedly increased with time, even though this non cooled line was not expected to be capable of causing the condensation of tar, being at a higher temperature than that of the walls of the upstream transfer line exchanger, encouraging condensation therein. Injecting 20 to 100 ppm, in particular 50 to 100 ppm with respect to the cracked gases of coke particles has been shown to be effective against these deposits. Optionally, coke can be directly injected downstream of the exchanger but this would necessitate supplementary operating means which are avoided in this disposition of the invention.

In a further embodiment, which is applicable in the case where particles are discontinuously injected into the transfer zone during the steam cracking operation, this operation can be modified at the instant the particles are injected by increasing the circulation rate of the cracked gases by 10% to 50%; this can be effected by momentarily increasing the hydrocarbon and steam flow rates, or solely the steam flow rate. The importance of this arrangement is that it increases the velocity and thus the erosive effect of the particles, and as a consequence reduces the quantity of injected particles; this is of particularly use for non recovered coke particles which are trapped downstream in the pyrolysis fuel.

In a further embodiment, the particles injected into the transfer zone can be introduced at one or more points where the circulation rate is reduced to at least 25% of the circulation rate in the terminal portion of the cracking zone. This has two important advantages: particles which are introduced into a gas with a low velocity acquire a lower kinetic energy which greatly reduces the risks of erosion of the tubular plate of the exchanger, and reduces the production of fines when the particles disintegrate against the tubular plate or against a suitable impacter.

The most suitable points for introducing the particles are generally located in the inlet cone for the transfer line exchanger. By definition, this inlet forms part of the transfer zone and not part of the indirect cooling means, which corresponds to the exchanger itself, i.e., to the tubes for circulation of the cracked gases which effect the indirect cooling.

Since in accordance with the invention the quantities of particles circulating in the cracking zone (2) are insufficient to eliminate the major portion of the coke formed in this zone, the invention provides for predominantly chemical decoking at relatively frequent intervals, or even continuously. Chemical decoking can be effected in various ways, all of which establish conditions for accelerated chemical gasification of coke, these conditions being accelerated with respect to normal steam cracking conditions where steam has a limited gasification action on coke, in particular via the water gas reaction.

The first variation consists in accelerating gasification by combustion of the coke by circulating air and/or air/steam mixtures; this variation is the conventional air decoking process, with the furnace disconnected from downstream systems, and an interruption in the hydrocarbon supply.

In a second known variation, supply of the hydrocarbon feed is interrupted and the coke is gasified by circulating steam alone or steam/hydrogen mixtures.

Steam decoking can be effected either leaving the furnace connected downstream or by disconnecting it in order not to mix substantial quantities of carbon monoxide CO with the cracked gases.

Outside these known decoking arrangements, we have unexpectedly found novel conditions for very efficient chemical decoking by injection upstream of the cracking zone of at least one mineral salt which catalyses the gasification of coke by steam under normal steam cracking conditions. The active compounds typically contain one or more mineral salts of elements selected from the group formed by alkalis and alkaline-earths, for example a salt of an element selected from the group formed by potassium, sodium, lithium, barium and strontium. Examples of active mineral salts are precursors for the oxides of the elements under consideration, in particular carbonates, or carbonate precursors such as acetates. Advantageously, salt compositions with a melting point of less than 750° C. are used, to encourage their transfer to the walls of the pyrolysis tubes. Compositions, which are almost eutectic compositions, for example an equimolar composition of potassium and sodium carbonates, are highly suitable. If it is desired to inject mutually incompatible compounds as regards storage, a plurality of stores and streams can be used.

These compounds can also be injected upstream of the cracking zone during "steam decoking" phases, as described above, to accelerate gasification (and also solely during these phases, if corrosion is feared in the case of permanent injection).

It is also possible to inject other types of chemical anticoking compounds, for example dimethyldisulphide and/or phosphorous-containing compounds, in particular phosphates or phosphites, or other compounds which may have an anticoking action (neutralisation of radicals and/or promotion of coke gasification), or reduction of CO formation, or an anticorrosive action.

French patent FR-A-2 411 876 describes examples of phosphorous-containing compounds.

When "steam decoking" of the coking zone is sequentially used, with or without injection of chemical compounds which catalyse gasification, this zone remaining in communication with the downstream means, the effluent from the indirect cooling means can be subdivided during the steam gasification phases into a minor portion which rejoins the downstream means and a major portion which is withdrawn from the circuit for the steam cracking effluents.

This allows the elimination of the major portion of the carbon monoxide contained in the effluents from steam decoking without having to disconnect the furnace.

The invention also provides a steam cracking facility for carrying out the process of the invention, comprising at least one steam cracking furnace comprising at least one cracking zone containing pyrolysis tubes connected downstream via a transfer line to at least one transfer line exchanger for effluents in which the inlet cone forms part of the transfer line, and downstream means for treatment of the effluent connected to said exchanger, characterized in that it comprises:

means for dosing and injecting solid erosive particles, these means being connected to the transfer line upstream of the transfer line exchanger and connected either directly to the pyrolysis tubes or upstream of said tubes;

means for measuring the temperature of the effluent at the outlet to the transfer line exchanger to control its fouling;

and chemical decoking means connected upstream of the pyrolysis tubes in the cracking zone, to establish accelerated gasification conditions for the coke in this zone.

The invention also provides a facility in which the particles are introduced into the inlet cone of the transfer line exchanger at at least one point, the introduction point or points being located in the inlet cone, such that the local cross section for the passage of cracked gases is at least 25% greater than the cross section of the initial portion of the transfer zone, reducing the risk of erosion of the tubular plate in the exchanger and wear of the particles.

In a variation, the facility comprises means for dosing and discontinuous injection of coke particles with an average diameter in the range 0.07 to 4 mm, which have good erosive efficiency and can be easily separated, connected to the transfer line to effect introduction of the totality of the coke particles injected upstream of the transfer line exchanger.

A facility of the invention advantageously uses, in the cracking zone, pyrolysis tubes connected together by turns, at least the majority of which are conventional non reinforced turns, which eliminates a very large overcost in the facility.

The invention also provides a facility which comprises means for dosing and injection of chemical compounds which catalyse gasification upstream of the cracking zone, comprising at least one active compound selected from the group formed by mineral salts of an element selected from the group formed by sodium, potassium, lithium, barium and strontium. These compounds greatly increase the steam cracking cycle time.

A very economical embodiment of the facility comprises a simplified apparatus for recovery of coke particles (particles with an average diameter in the range 0.07 to 4 mm introduced into the transfer zone); this apparatus can be installed in at least one evacuation line for the cooled steam cracking effluents, comprising at least one furnace outlet valve, the apparatus being disposed between the outlet from the indirect cooling means such as a transfer line exchanger and the furnace outlet valve. In this apparatus, the evacuation line includes a sudden change in direction in the form of a simple turn at an angle of between 30° and 180° to evacuate at least the majority of the steam cracking effluents, and a recovery chamber for the particles located at the level of the sudden change or downstream thereof, connected by a throttle to a reservoir for receiving recovered coke particles, and means for maintaining this reservoir in an atmosphere which is uncondensable under the reservoir conditions. This apparatus utilises the inertia of the particles to separate at least a portion thereof from the gases due to the sudden change in direction. This apparatus is far more economical than cyclone type apparatus where the flow follows a helical trajectory.

In a further embodiment of a facility of the invention comprising means for dosing and injecting coke particles connected to the transfer zone, and gas/solid separation means supplied by the effluents from the transfer line exchanger, the facility also comprises means for circulating non recovered coke particles to the downstream means.

As an example, it may comprise means for discontinuous introduction of a gaseous stream simultaneously with at least some of the coke particle injections, to disturb the operation of the gas/solid separation means and provoke the circulation of at least a portion of the injected coke particles towards the downstream means.

This apparatus is far simpler than injecting the coke particles downstream of the separation means since it only uses one supplementary gas introduction step and not supplementary means for introducing particles.

This novel process is far superior to the prior art process both from the point of view of reliability and reduction of erosion risks under flexible conditions, and from an investment cost viewpoint.

The invention will be better understood, and other details and advantages will become more clear from the following description made by way of example and with reference to the accompanying drawings.

DETAILED DESCRIPTION OF THE DRAWINGS

FIG. 1 shows a steam cracking furnace (20) delimited by its housing, comprising a preheating convection zone (1), a cracking zone (2) containing pyrolysis tubes, located in the radiation zone of the furnace, a transfer zone (3) comprising a transfer line located just at the outlet to the cracking zone and an inlet cone for a transfer line exchanger (TLE), the tubes for circulating the cracked gases in this exchanger constituting indirect cooling means (4) for the steam cracking effluents from zone (2) passing through transfer zone (3).

The effluents from the transfer line exchanger are guided via line (10) to downstream means (6) for the treatment of cooled effluents which are well known to the skilled person. They comprise, for example, direct cooling means, primary fractionation means, compression means, drying means, desulphurisation means, cooling means and final fractionation means for the constituents of the cracked gases, typically to produce ethylene, propylene, a $C_4$ fraction, a spirit fraction and a pyrolysis fuel fraction.

Line (10) for evacuating the cooled effluents also includes a furnace outlet valve ($V_F$) allowing it to be isolated from the downstream means (6). The line passes through a gas/solid separator (S) for particle recovery. Particles recovered, from separator (S) fall into a receiving reservoir (12) via a line which forms a throttle and includes an isolation valve (13). Means (21) feed a limited supply of a barrier gas (steam, nitrogen or fuel gas) to maintain the receiving reservoir (12) in an atmosphere which is uncondensable under the conditions in the reservoir. A decoking line (19) is also connected to this line and comprises a valve ($V_{DK}$) termed a decoking valve. This line is used during air or air/steam mixture decoking phases to evacuate the coke combustion gases, generally to a decoking tank, not shown here.

The particles contained in reservoir (12) are evacuated and eliminated or recycled via line (30) to injection means (7).

One line, connected to line (10) and including a valve (14) can allow the major portion of the CO rich gas to be extracted, during particular decoking phases, use steam alone or steam/hydrogen mixtures to reduce the average CO content in the cracked gases in the downstream treatment means (6), when using this particular decoking arrangement. Line (10) also includes means (16) for measuring the temperature of the effluents from the transfer line exchanger, to control the process of the invention. Means (16) may be connected to means (7) for dosing and injection of the solid particles. In a variation of the process, other means such as a line (25) allow the supply of a larger flow of gas to perturb the operation of the separation means (S) and allow coke particles to circulate towards the downstream means (6), allowing line (10) and the lines downstream of line (10) to be decoked.

The facility thus also comprises means (7) for dosing and injection of solid particles, which can be introduced:

- via line **(7*a*) into transfer zone (3) connecting cracking zone (2) to indirect cooling means (4)**, which are constituted by tubes for the circulation of cracked gases from the transfer line exchanger (TLE);
- optionally, via line **(7*b*) into cracking zone (2) or upstream of that zone, to circulate in at least the terminal portion (last straight length) and generally in the whole of the coil of pyrolysis tubes in cracking zone (2)**.

In accordance with the invention, at least 70% by weight of the particles are introduced into transfer zone (3). Without going beyond the scope of the invention, the particles can be introduced at the end of zone (3) to where it passes out of the housing of the furnace radiation zone or even several tens of cm upstream; this has no advantages, however.

More particularly, the particles are injected into the inlet cone of the exchanger where the local cross section for passage of the cracked gases is greater by at least 25%, for example 40% to 400%, than the cross section for these gases in the initial portion of transfer zone (3). Limiting the velocity of the gas at the particle introduction points is highly beneficial, since it greatly reduces the risks of erosion of the tubular plate of the exchanger. This tubular plate may also, and particularly advantageously, be protected by an impacter, not shown, located in the TLE inlet cone, just downstream of the particle introduction points, for example an impacter which is substantially opaque, or at least 70% opaque viewed from the entry of the gas into the inlet cone. In particular, a gas permeable impacter constituted by several chicanes or rows of surfaces offset to each other will both protect the tubular plate of the TLE and improve the distribution of the injected particles into the different tubes of the exchanger. An impacter of this type is shown in FIG. 2.

The particles are pneumatically transported from means (7) to their introduction points by means of a carrier gas, for example steam, fuel gas or nitrogen.

Known conventional means such as valves, pneumatic deflectors, screws, locks, storage drums, and weighing means can be used to transfer the solid particles.

In one variation of the invention, the facility comprises means (15) for dosing and injection of chemical compounds which catalyse the gasification of coke by steam. As an example, dilute aqueous solutions of sodium carbonate and potassium carbonate can be used, in particular compositions which are close to the eutectic such as a composition containing 50 molar % of these two carbonates.

It is also possible to use acetates of active compounds from the group formed by alkalies and alkaline-earths, for example an equimolar composition of sodium acetate, potassium acetate, lithium acetate and barium acetate.

These two solutions can also be used together (stored and supplied separately to avoid problems associated with incompatibility).

These non limiting examples of active compounds have shown a surprising efficiency in accelerating the gasification of coke by steam, substantially reducing and even halting coking in the pyrolysis tubes.

The facility described in FIG. 1 also provides injection by means (15), as a mixture or separately, of other types of chemical anticoking compounds, in particular compounds which can reduce the CO content in the cracked gases, or with anticoking activity (for example radical neutralisation, with or without catalysis of gasification by steam).

It is possible to inject dimethyldisulphide (DMDS), or soluble phosphorous compounds, for example benzyldiethylphosphite, whose activity is known, in an appropriate solvent such as water, hydrocarbons, or hydrocarbon/alcohol. Further non limiting examples are active phosphorous compounds selected from the group formed by organic compounds (triethylphosphite, triphenylphosphite), and soluble phosphates or phosphites of sodium, potassium, lithium or barium, preferably compounds which also act as a catalyst for gasification and/or an anticorrosive action.

Apart from means (15), the facility of FIG. 1 also comprises other means for establishing accelerated coke gasification conditions in cracking zone (2): these means comprise means for introducing (for example valve (18)) for introducing decoking air (AIR), and means for interrupting the supply of hydrocarbon (for example valve (17)) to allow the circulation of decoking steam alone (optionally with added hydrogen using means which are not shown).

Finally and obviously, the facility comprises means for introducing a hydrocarbon feed (HC), and means for introducing diluting steam ($H_2O$) into the cracking zone. It also comprises means for increasing the volume flow rate of cracked gases in the transfer line exchanger from 10% to 50% at the instant of particle injection, for example means (24) for supplying supplemental steam. The hydrocarbon flow rate can also be increased during injections. This increase in the volume flow rate of the particles increases their velocity, and thus their erosive effect, which means the quantity injected can be reduced. This is of particular use when injecting coke which is not recovered and/or not recycled. The tubes for circulation of cracked gases from the transfer line exchanger can also be obstructed by 4% to 30% in order to increase the circulation rate and the erosive efficiency.

Figure 2B:
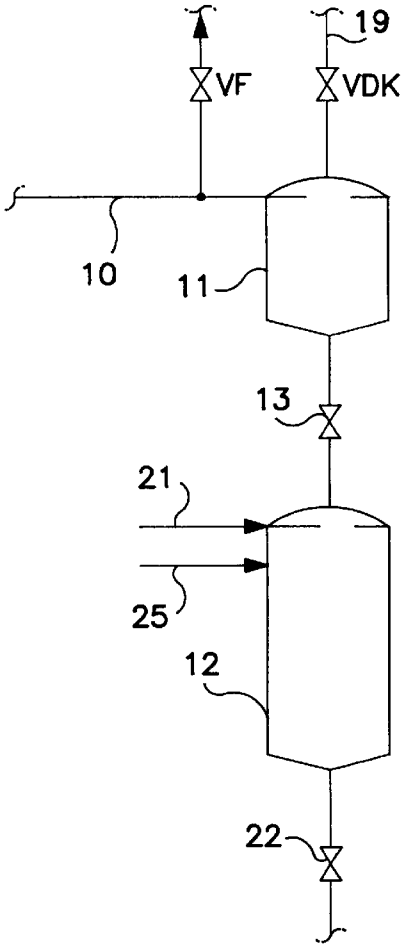
FIG. 2 schematically shows two embodiments (FIGS. 2A and 2B) of a part of a steam cracking facility according to a variation of the invention.
Figure 2A:
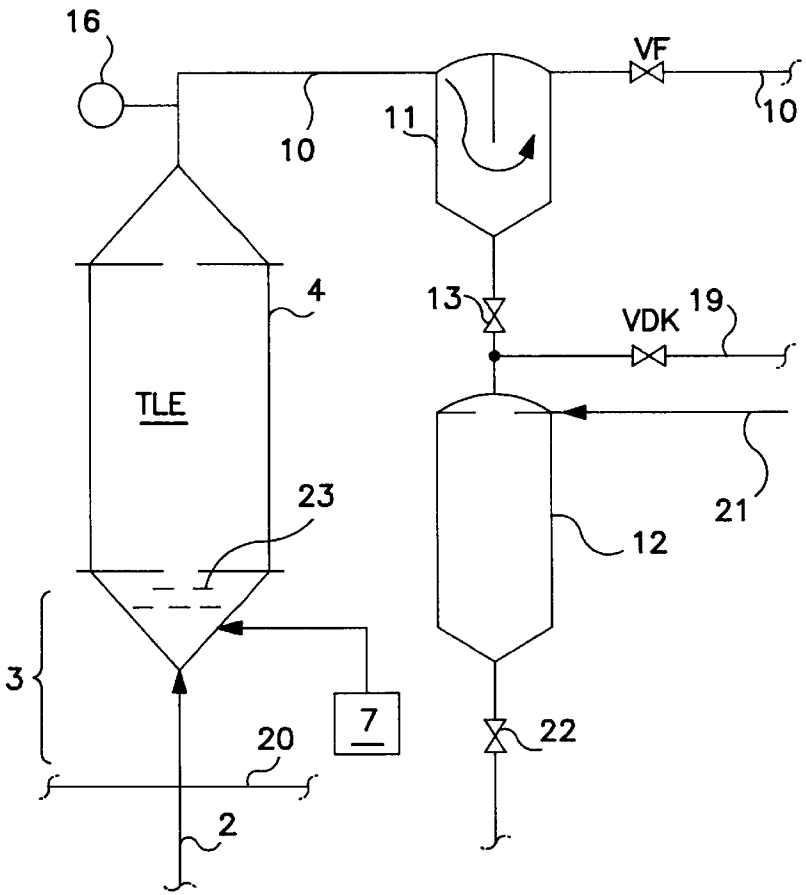

FIG. 2, and firstly FIG. 2A, represents a transfer line exchanger with cooling tubes for cracked gases (4), with an inlet cone into which, during one steam cracking cycle, an average quantity Q of solid particles are introduced via dosing, transport and solid particle injection means (7). The particles, introduced at at least one point into the cone, and thus into one point in transfer zone (3) so that the velocity of the cracked gases is less than 25% of the velocity in the initial portion of the transfer zone (3), have a greatly reduced kinetic energy, which limits the risk of erosion of the tubular plate of the exchanger. Impacter (23), disposed just downstream of the particle introduction points, is constituted by two offset impact surfaces so as to be both permeable to gas and at least 70% opaque, preferably substantially 100% opaque, viewed from the inlet line for the cracked gases. This impacter provides highly effective supplemental protection for the tubular plate against erosion, and also distributes the particles more evenly into the different tubes of the exchanger.

From the outlet to the transfer line exchanger, the cracked gases are transported via line (10), comprising means (16) for measuring the temperature of the effluents from the transfer line exchanger. These means (16) effectively indicate the degree of fouling in the exchanger and allow the process to be controlled by modulating the quantities of particles injected or the frequency of injection, so that the increase in the temperature of the exchanger outlet does not exceed 100° C. per month, preferably 50° C. per month. Advantageously, this temperature derivative is limited to 30° C. per month, or the quantity of injected particles is such that the temperature at the exchanger outlet remains substantially constant.

The cooled steam cracking effluents evacuated via line (10) pass through separation chamber (11) which includes a chicane which forces the gas stream to change direction suddenly. This sudden change in direction forces a substantial portion of the particles transported by the gases to separate, in particular the coke fragments which detach from the walls of cracking zone (2) or the particles injected in accordance with the process. The recovered particles fall into receiving reservoir (12), through a throttle including a valve (13); means (21) for injecting an inert gas (more precisely with a very low condensation point), i.e., a gas selected from the group constituted by steam, fuel gas, nitrogen, or with a condensation temperature of less than or equal to 100° C. at atmospheric pressure. The throttle causes the inert gas to act as a barrier by rising in chamber (11), which means that the particles recovered in chamber (12) remain there without condensing by maintaining the reservoir at a sufficient temperature.

Closing valve (13) located at the throttle isolates reservoir (12) and the particles it contains can be emptied using evacuation means (22), under gravity, mechanically (in particular a screw), or pneumatically, the means including a valve.

The decoking line (19), comprising a decoking valve ($V_{DK}$) which is used during air decoking phases of cracking zone (2), is connected directly or indirectly to line (10), upstream of furnace outlet valve ($V_F$), to allow evacuation of the air decoking effluents. The assembly formed by chamber (11), reservoir (12) and their connecting line containing a throttle is disposed substantially at the level of the connection between evacuation line (10) and decoking line (19). This allows recovery of not only at least a portion of the inject erosive particles in reservoir (12), but also fragments of coke formed on the walls of cracking zone (2) and detached from those walls in particular during accelerated gasification and particularly during the air or air/steam mixture decoking phase, which provokes partial disintegration of the coke formed.

FIG. 2B represents the same portion of the facility but in a variation in which the solid particle recovery apparatus is simplified: recovery chamber (11) is not traversed by a stream of cracked gases circulating in line (10), but is located immediately after the sudden direction change (for example at a distance of not more than 1.5 m, preferably less than 0.8 m). The solid particles transported by the stream tend to continue in a straight line without carrying out the sudden direction change and are thus collected in chamber (11) and recovered in reservoir (12).

The embodiments described in FIGS. 2A and 2B are much more economical than conventional recovery in a cyclone.

Conventional cyclone recovery, which has a very high recovery efficiency, will be preferred when mineral particles (which are not combustible) are injected, which could cause a great deal of pollution in the downstream treatment means (6) and in particular in pyrolysis fuel; in this case, almost complete recovery of the particles is desirable.

In contrast, the simplified recovery means such as those presented in FIGS. 2A and 2B are perfectly suitable for the embodiments of the process using coke particles. It is in fact far less onerous to pollute the pyrolysis fuel with coke particles, which are combustible. It must be pointed out, however, that the efficiency of these simplified recovery apparatus is closely linked to the characteristics of the process of the invention, in particular to predominating (minimum 70%) or total injection into the transfer line. We have shown that, unexpectedly, coke particles injected at the inlet to zone (2) at a flow rate q and passing through the tubes of the transfer line exchanger (4) downstream would have a far lower decoking efficiency in the exchanger than the same quantity of particles injected into the exchanger cone, into transfer zone (3). In addition, coke particles injected into the inlet to cracking zone (2) are practically not recoverable downstream of the exchanger using the simplified means and only moderately so by a cyclone.

In contrast, particles injected into zone (3), in particular at a point in the cone with a slower circulation rate for the cracked gases, are both efficient in decoking, and recoverable in appreciable amounts, for example 60% using the simplified means, particularly for coke particles with large diameters, in the range 0.07 to 4 mm for this embodiment of the invention.

These results can be interpreted as follows: the coke particles introduced at the inlet to zone (2) impact in this zone at very high speeds (typically 120 to 200 m/s) against a large number of turns. These particles thus disintegrate to dust which is less effective for erosion in the exchanger and very difficult to separate from the gas.

The invention is thus characterized by steam cracking which jointly uses essentially erosive decoking in the transfer line exchangers (TLE) and essentially chemical decoking in the tubes of the cracking zone, using simple and reliable means of controlling the process and means which are economical to use.

These two aspects of the process mutually reinforce each other by a synergistic effect:

Chemical decoking alone, which is very effective for pyrolysis tubes, is less effective or ineffective in the tubes in the transfer line exchanger:

These transfer line exchanger tubes (and the adjacent coke layer) have an operating temperature of between 300° C. and 400° C., at which temperature air combustion reactions or steam gasification reactions (water gas reaction: $C+H_2O \rightarrow CO+H_2$) are extremely slow, even with the addition of chemical additives.

Erosive decoking alone, on the other hand, is highly effective for the transfer line exchanger and is also possible in the two zones, cracking and cooling, but runs technological risks in the cracking zone under variable operating conditions.

The process of the invention, which involves the injection of at least 70% by weight of the particles into the transfer zone, these particles thus circulating at a reduced velocity (with respect to the velocity in the pyrolysis tubes) with low wall temperatures and in tubes which are substantially straight without turns, no longer runs major erosion risks.

Thus, by injecting 70% or preferably 90% by weight, or even the totality of the particles, into transfer zone (3), the quantity of particles injected into or upstream of cracking zone (2) can be greatly limited or even reduced to zero. This limit (200 ppm maximum, preferably 100 ppm, in particular maximum 60 ppm, and preferably 30 ppm for angular mineral particles) means that pyrolysis tubes can be used in cracking zone (2) which are connected by conventional, non reinforced turns.

This is a considerable advantage: for an existing steam cracking facility, the invention can be put into production with an investment which is reduced by about 30% to 40% compared with an operation where the existing turns are changed to reinforced turns. This economy is in fact even greater if the losses connected with production stoppages for installing supplemental equipment are taken into account.

The facility and its variations as shown in FIGS. 1, 2A and 2B operate as follows, as described in the following description and illustrated and explained in the examples:

Solid particles, which can be stored in a large capacity reservoir for new particles or in a much smaller reservoir containing a dose of particles which have already been circulated in a portion of the facility, are measured, for example by weighing, and sent discontinuously and sequentially to the different portions of the facility (for example sequentially to the inlet cones of the different transfer line exchanger). If the particle dose has already been circulated in the facility, it may be necessary to add some new powder to obtain the desired quantity, or to eliminate that quantity of "used" particles if the coke erosion properties or its flow properties have deteriorated.

Preferably, the powder is injected in discontinuous doses. One dose can typically comprise 2 to 300 kg of particles, preferably 5 to 100 kg of particles.

By way of example, when considering a transfer line exchanger, supplied with cracked gases from two pyrolysis coils in a cracking zone (2) with a capacity of 10000 kg/h (hydrocarbons+steam), one possible mode of operation may be:

- injection of a dose of 30 kg of particles every 10 hours into the inlet to the transfer line exchanger;
- injection during a steam cracking cycle of 1000 hours (operating at nominal capacity with hydrocarbons+ steam), of 6 doses of 20 kg of particles, injected in the first 72 hours of the cycle, to the inlet to the cracking zone (2).

In this example, the value of $\overline{Q}$ (the quantity of particles injected into the transfer zone, compared with the gases cracked during a steam cracking cycle) is 300 ppm: an average value of 3 kg/h of particles for 10000 kg/h of cracked gases.

The value of $\overline{q}$ is 12 ppm (0.12 kg/h of particles, as an average value over the whole steam cracking cycle, for 10000 kg/h of cracked gases).

This example thus conforms with the invention for the injection of particles, $\overline{Q}$ representing 96% of $[\overline{Q}+\overline{q}]$. This condition is however not necessarily sufficient: the operator must, as a function of the feed treated, adapt the quantities of particles to ensure fouling of the transfer line exchanger remains moderate (more precisely, the increase in temperature of the effluents must be less than 100° C. per month, preferably less than 30° C. per month, or even zero). The operator must monitor the temperature at the outlet to the exchanger by observing temperature gauge (16) and can then modify the quantity of particles injected, in particular $\overline{Q}$. He may, for example, increase $\overline{Q}$ by injecting particle doses which are greater than 30 kg, and/or increase the frequency of injections, or he may reduce $\overline{Q}$ if the value used appears to be excessive. This observation can typically be made once a day for a known feed, and at shorter intervals during each change in the operating conditions.

In a further implementation, a dose is injected when the temperature attains a preset value (for example 430° C., if the allowable temperature limit is 450° C.). These operations can be carried out by the operator, manually or automatically.

Doses of powder can be transported by pneumatic transfer, by means of a carrier gas with a boiling point of not more than 100° C. at atmospheric pressure, typically steam, fuel gas (methane or methane/hydrogen) or nitrogen, as a dilute phase or as a dense phase using known techniques.

Three options can also be employed by the operator:

a) to reduce the particle consumption, the operator can temporarily increase the flow rate of the cracked gases at the instant of particle injection, for example by 10% to 50% by volume, to increase the velocity and erosive effectiveness of the particles. This can be particularly advantageous when coke is injected, in particular coke which is not recovered, and can be effected by increasing the steam flow rate by means (24) such as a valve, which is given by way of non limiting example.

b) If the operator fears that tar will condense on the recovered particles, in the case of some atypical, very heavy feeds, the operator can interrupt the hydrocarbon supply at the instant of particle injection, to inject the particles into a stream of steam alone, optionally at a modified flow rate.

c) If heavy or very heavy feeds are cracked and the risk of residual fouling in line (10) for evacuating the cooled cracked gases needs to be reduced, in particular downstream of the particle separation and recovery means (cyclone or simplified means) and/or the furnace outlet valve ($V_F$), coke particles can be circulated (5 to 200 ppm, preferably 10 to 100 ppm with respect to the cracked gases) into the portion downstream of line (10) which rejoins the downstream means (6). These coke particles can be introduced into transfer zone (3) and at least a substantial portion pass through the separation means without being collected, using a gas stream which perturbs the operation of the separation means and limits the efficiency of these means.

The gas stream which perturbs the operation of the separation means (S, 11) is introduced via line (25) and prevents recovery of at least a portion of the coke particles injected into transfer zone (3).

In order to evacuate the recovered particles, for example in apparatus such as those described in FIGS. 2A and 2B, the operator can effect evacuation without stopping the steam cracking cycle by closing valve (13), and opening valve (22), optionally with additional means which are not shown (pneumatic, mechanical such as a screw, or a lock), or simply by gravity evacuation.

Advantageously, the recovered particles are transferred to various points in the facility for storage and/or further treatment before being recycled.

Several options are available for carrying out accelerated chemical gasification of the coke in zone (2):

a) The operator can carry out conventional decoking by combustion of coke with air or air/steam mixtures once the cracking zone has been fouled to a limiting value.

b) A second decoking mode consists of carrying out decoking with steam alone, as known by the skilled person. Hydrogen may be added to the steam.

In a variation, a major portion of the decoking steam stream, charged with CO and $CO_2$, can be extracted from the system for collecting the cracked gas for means (6) to reduce the CO and $CO_2$ content of the collected cracked gases.

c) In a variation, the decoking conditions for steam alone, such as those described in b), can be accelerated by the addition of chemical gasification catalysts, as described above, whose efficiency is surprisingly very high.

d) Finally, the operator can substantially prolong the hydrocarbon cycle time by injecting chemical compounds, which catalyse gasification with unexpectedly intense activity compared with known additives, during the normal steam cracking operation.

The invention will be better understood from the following examples:

EXAMPLE 1 COMPARATIVE

A steam cracking facility was used which comprised 10 furnaces and 20 transfer line exchangers connected upstream to banks of pyrolysis tubes or coils, with an 80 m tube length containing 8 straight vertical lengths per tube bank. The average circulation rate was between 120 and 150 m/s in cracking zone (2) and between 60 and 90 m/s in the transfer line exchanger tubes.

This typical facility had been designed for naphtha cracking with a cycle time of about 55 days, decoking being carried out in air and with air/steam mixtures (and occasionally hydraulically for the transfer line exchangers).

If this facility were to be supplied with kerosine or crude condensates, or hydrotreated vacuum distillate, the cycle time would typically fall to below 15 days, which would render the facility difficult if not impossible to operate.

If this facility were to be supplied with heavy gas oil or virgin vacuum distillate, the cycle times would be reduced to less than 7 days, for example 2 days, which would not be acceptable.

This facility thus cannot be flexibly fed. The use of known chemical decoking means (in air or steam alone or with added hydrogen) cannot prevent the collapse of the cycle times for steam cracking when cracking heavy feeds.

EXAMPLE 2 COMPARATIVE

A process involving elimination of coke by erosion in the cracking zone and the transfer line exchanger was used to obtain substantially continuous operation. This process necessitated changing all the turns in the cracking zone in each of the furnaces and replacing them by specially reinforced turns (modified geometry, increased thickness, and optionally a change of materials).

In this process, a layer of coke was allowed to form, for example by carrying out steam cracking over 48 hours with a naphtha feed, then injecting quantities of erosive particles with an average diameter of less than 150 micrometers into the inlet to zone (2) in sufficient quantities to eliminate at least the major portion of the coke formed.

As an example, 4500 ppm of angular corundum with an average diameter of 70 micrometers was used, all of it being injected into the inlet to cracking zone (2) by injections which were spaced apart by 2 to 5 hours.

This quantity could be altered, for example raised to 5500 ppm when cracking heavy feeds (gas oil, vacuum distillate) and it could also be altered as a result of readings provided by pyrometers measuring the skin temperatures of the tubes.

This facility, which was not in accordance with the invention (in particular, $\overline{Q}$=0), could crack very different feeds, among them heavy feeds, but had substantial technological risks as regards erosion in the cracking tubes in particular when operated under variable conditions with flexible feeds.

EXAMPLE 3

The same facility as in Example 2 was used, but without changing the turns in cracking zone (2). A medium amount of corundum or angular silicon carbide with an average diameter of between 100 and 300 micrometers was injected into the inlet cones of the transfer line exchangers.

The following injections conditions could be used:

for a naphtha feed, $\overline{Q}$=100 ppm of injected particles at intervals of 12 to 18 hours;

for a gas oil feed or vacuum distillate feed, $\overline{Q}$=300 ppm of particles injected at intervals of 4 to 10 hours.

These values were subsequently modified, separately for each transfer line exchanger as a function of the outlet temperature readings, the derivative of which did not exceed 20° C. per month, or stabilised. Supplementary injections could have been made if the temperature at the exchanger outlet exceeded 430° C. or 440° C. (for an allowable limit of 450° C.).

The particles were recovered in cyclones at the outlets from the TLEs, screened to eliminate coarse coke fragments which may have been present, and at least a portion was recycled, optionally after elimination of very fine particles.

The cracking zone was chemically decoked by an air/steam mixture or steam alone when the skin temperatures reached a limiting value.

The cycle times were typically: 50 to 70 days for a naphtha feed, 40 to 60 days for a gas oil feed, and 25 to 45 days for a heavy gas oil feed or a medium quality vacuum distillate.

This facility, which was in accordance with the invention, did not carry out substantially continuous steam cracking, but operated with high safety as regards technological problems (erosion) under flexible feed conditions. Further, the equipment required to equip an existing furnace was far more economical than that of Example 2 where changing the turns involved an extra cost of more than 30%.

EXAMPLE 4

The facility of Example 3 was used with additional means for injecting chemical compounds:

80 ppm of chemical compounds with respect to the cracked gases (percentage by weight of the alkaline elements K+Na), diluted to form an aqueous solution containing 96% water with an equimolar composition of potassium carbonate and sodium carbonate, sprayed into the feed at the convection outlet (HC+$H_2O$ at 500° C.);

80 ppm of benzyldiethylsulphite added to the hydrocarbon feed, with respect to the feed.

This facility, which was in accordance with the invention, could operate in flexible mode with cycle times which generally exceeded 60 days for the feeds considered.

It would also have been possible to inject a low quantity $\overline{q}$ of angular silicon carbide with an average diameter of 70 micrometers, for example $\overline{q}$=15 ppm into the inlet to zone (2) to increase the cycle time (from 5% to 20%). Injection was carried out over the first 72 hours of the cycle.

In the facilities of Examples 3 and 4, the particles were injected during normal steam cracking. In a variation, when using heavy feeds, it was also possible to inject and interrupt the hydrocarbon feed for a very short period, for example one injection of particles every 10 hours, with an increased steam flow rate for 10 minutes from injection when only steam is circulated.

In addition to the injection of recovered mineral particles, it was also possible to circulate a small quantity (for example 40 ppm with respect to the cracked gases) of coke particles which were not recovered (because of an injection of gas to reduce the efficiency of the cyclones or simplified particle recovery means), to eliminate residual coke deposits in the evacuation line (10) and in the downstream lines.

EXAMPLE 5

A modified steam cracking facility was used to obtain flexibility of partial feeds: $C_2$, $C_3$, $C_4$, naphtha, crude condensates (a mixture of naphtha with fractions of kerosine and gas oil).

The facility described in FIGS. 2A and 2B (for example 2A) was well adapted to this partial flexibilisation. Metallurgical coke particle which had been calcined at above 850° C. and ground, with an average granulometry (50 weight %) of 70 to 800 micrometers was injected into the inlet cones of the transfer line exchangers and partially recovered in chamber (11) and reservoir (12).

20 to 400 ppm of coke, in injections spaced by 8 to 12 hours, for example, could be injected to limit the temperature derivative at the outlet to a maximum of 30° C. per month. The efficiency of these particles could be increased by increasing, by means of injections, the volume flow rate of the cracked gases by 20% to 30% by addition of supplemental steam.

In Examples 4 and 5, the pyrolysis tubes in zone (2) could be decoked using steam or air/steam mixtures or by using chemical additives which catalysed the gasification either during steam cracking or during steam decoking phases.

The invention in its different variations thus means that a wide flexibility of feeds can be obtained, in a manner compatible with existing facilities, in particular by retaining the existing transfer line exchangers which provide a favourable energy balance, both economically and reliably, which could not be achieved with any of the known processes.

We claim:

1. A process for steam cracking hydrocarbon feeds in a steam cracking facility comprising at least one steam cracking furnace which comprises at least one cracking zone (2) containing pyrolysis tubes, connected via a transfer zone (3)

to indirect cooling means (4) for the effluents from that cracking zone (2), and downstream means (6) for the treatment of the cooled effluents, the process comprising injection of solid erosive particles upstream of the indirect cooling means (4) to eliminate at least a portion of the carbon-containing deposits located on the internal walls of the facility, the cracking zone remaining in communication with the downstream means (6) during the particle injection phases, the process being characterized in that:

a) during a steam cracking cycle, solid erosive particles are injected with a diameter in the range 0.02 mm to 4 mm, at at least one point in the transfer zone (3), the particles then circulating in the indirect cooling means, transported by a carrier gas with an average velocity in the range 20 to 180 m/s, the average amount, $\overline{Q}$, of particles injected into said transfer zone during a steam cracking cycle being at least 0.7 times the overall average amount, $[\overline{Q}+\overline{q}]$, with respect to the cracked gases, of particles injected upstream of the indirect cooling means (4) during the same steam cracking cycle, $\overline{q}$ being the average amount of particles introduced into and/or upstream of said cracking zone;

the overall average amount, $[\overline{Q}+\overline{q}]$ of injected particles being set so as to limit the increase in the temperature at the outlet from the indirect cooling means (4) to a value of less than 100° C. per month, b) in the cracking zone (2), either continuously or discontinuously at intervals not exceeding 4 months, establishing accelerated coke gasification conditions to maintain the operation of the cracking zone.

2. A process according to claim 1, characterized in that the average amount $\overline{q}$ of solid particles injected upstream of the cracking zone (2) and/or into said zone is less than 200 ppm with respect to the cracked gases, during a steam cracking cycle, and in particular in that the solid particles comprise an average amount of angular, substantially non porous mineral particles of less than 60 ppm, with respect to the cracked gases.

3. A process according to claim 1, characterized in that the totality of the erosive particles injected upstream of indirect cooling means (4) is injected into said transfer zone (3), the value of $\overline{q}$ being zero.

4. A process according to claim 1, characterized in that the average amount $[\overline{Q}+\overline{q}]$ of particles injected upstream of the indirect cooling means is between 20 and 3000 ppm with respect to the cracked gases, during a steam cracking cycle.

5. A process according to claim 1, characterized in that the particles injected into the transfer zone (3) are coke particles.

6. A process according to claim 5, characterized in that at least the major portion of the injected coke particles have been subjected to a temperature of at least 850° C. during their manufacture.

7. A process according to claim 1, characterized in that the injected particles are mineral particles selected from the group consisting of silicon carbide and simple or mixed silicon, aluminium and zirconium oxides.

8. A process according to claim 1, characterized in that the solid particles comprise at least 20% by weight of angular particles.

9. A process according to claim 1, characterized in that an average amount $[\overline{Q}+\overline{q}]$ of particles is injected during a steam cracking cycle which is sufficient to limit the increase in the temperature at the outlet from indirect cooling means (4) to a value of less than 30° C. per month, during a steam cracking cycle.

10. A process according to claim 9, characterized in that the average amount $[\overline{Q}+\overline{q}]$ of particles injected during a steam cracking cycle is determined so as to substantially stabilise the temperature of the effluents from the indirect cooling means (4).

11. A process according to claim 10, comprising establishing a maximum design temperature of the effluents from the indirect cooling means (4), measuring said temperature, and injecting said particles when said measured temperature exceeds said maximum design temperature.

12. A process according to claim 1, characterized in that the erosive particles are injected discontinuously at fixed or variable intervals in the range 0.3 to 72 hours.

13. A process according to claim 1, for cracking feeds comprising heavy feeds, the process comprising discontinuously injecting solid particles into the transfer zone (3), separating them from the cooled cracked gases downstream of said means (4), and recovering these particles, characterized in that the furnace feed is modified during the particle injection phase by substituting a lighter feed selected from the group consisting of steam, hydrocarbons with a boiling point of less than 250° C., and mixtures thereof.

14. A process according to claim 1, characterized in that particles are discontinuously injected into the transfer zone (3) during the normal steam cracking operation, the instantaneous quantity of particles being in the range 0.5% to 20% by weight, with respect to the cracked gases.

15. A process according to claim 1, characterized in that particles are discontinuously injected into the transfer zone (3) during operation of the steam cracker modified by increasing the circulation rate of the cracked gases by 10% to 50% at the instant of particle injection.

16. A process according to claim 1, characterized in that coke particles are injected into the transfer zone, and at least a portion of said particle is not recovered before the effluents have left the furnace and circulates towards the downstream means (6).

17. A process according to claim 1, characterized in that the particles injected into transfer zone (3) are introduced at one or more points where the circulation speed is reduced to at least 25% of the circulation rate in the initial portion of the transfer zone (3).

18. A process according to claim 1, characterized in that said accelerated chemical gasification conditions are conditions for coke combustion by circulation of gases selected from the group formed by air and air/steam mixtures.

19. A process according to claim 1, characterized in that said accelerated chemical gasification conditions are conditions for the gasification of coke by steam, by circulation of gases selected from the group consisting of steam and steam/hydrogen mixtures, the hydrocarbon feed supply being interrupted.

20. A process according to claim 19, characterized in that gasification by steam is accelerated by injection upstream of the cracking zone (2) of mineral salts which catalyse the gasification.

21. A process according to claim 1, characterized in that said accelerated gasification conditions comprise conditions for the gasification of coke by steam by circulation of a hydrocarbon/steam mixture under steam cracking conditions accelerated by injection upstream of the cracking zone (2) of mineral salts which catalyse gasification.

22. A process according to claim 20, characterized in that the gasification catalysts comprise mineral salts of elements selected from the group consisting of potassium, sodium, lithium, barium and strontium.

23. A process according to claim 1, characterized in that anticoking compounds are injected during steam cracking, said compounds being from the group consisting of dimethyldisulphide and phosphorous-containing compounds.

24. A process according to claim 19, characterized in that conditions for gasification by steam are sequentially established in cracking zone (2), said zone (2) being in communication with the downstream direct cooling means (6) and the effluent from the indirect cooling means (4) is divided during the gasification phases into a minor fraction which rejoins the downstream direct cooling means (6) and a major fraction which is extracted from the circuit for the steam cracking effluents.

25. A steam cracking facility comprising at least one steam cracking furnace (20) comprising at least one cracking zone (2) containing pyrolysis tubes connected downstream via a transfer line (3) to at least one indirect transfer line exchanger (4), and downstream means for treatment of the effluent connected to said exchanger, characterized in that it comprises:

means (7) for dosing and injecting solid erosive particles, these means (7) being connected to the transfer line (3) to introduce at least 70% by weight of solid particles injected upstream of the transfer line exchanger and connected either directly to the cracking zone or upstream of said zone;

means for measuring the temperature of the effluent at the outlet to the transfer line exchanger (4) to control its fouling;

and means (15, 17, 18) for chemical decoking connected upstream of the pyrolysis tubes in the cracking zone (2), to establish accelerated gasification conditions for the coke in this zone (2).

26. A steam cracking facility according to claim 25, characterized in that the chemical decoking means comprise means for dosing and injecting chemical compounds which catalyse gasification.

27. A steam cracking facility according to claim 25, characterized in that the pyrolysis tubes in the cracking zone (2) are connected together by turns, at least the majority of which are, non reinforced turns.

28. A steam cracking facility according to claim 25, characterized in that the particles are introduced into the inlet cone of the transfer line exchanger (4) at at least one point, the introduction point or points being located in the inlet cone such that the local cross section for the passage of cracked gases is greater by at least 25% than the cross section of the initial portion in the transfer zone (3).

29. A steam cracking facility according to claim 25, characterized in that it comprises means (7) for dosing and discontinuous injection of coke particles, the means (7) being connected to the transfer line (3) to introduce the totality of injected coke particles upstream of the transfer line exchanger (4).

30. A steam cracking facility according to claim 29, comprising a steam cracking furnace comprising at least one line (10) for evacuating cooled steam cracking effluents, which comprises at least one furnace outlet valve ($V_F$), characterized in that the evacuation line (10) comprises, between the outlet from the indirect cooling means (4) and the furnace outlet valve ($V_F$), a sudden change in direction in the form of a simple turn through an angle in the range 30° and 180°, to evacuate at least the major portion of the steam cracking effluents, a particle recovery chamber (11) located at the level of the sudden change in direction or downstream thereof, connected by a throttle to a reservoir (12) for receiving the recovered coke particles and means (21) for maintaining the reservoir (12) in an atmosphere which is uncondensable under the reservoir conditions.

31. A steam cracking facility according to claim 30, further comprising a decoking line (19) connected to line (10) for evacuation of the cooled cracked gases and comprising a valve ($V_{DK}$), characterized in that the assembly constituted by the particle recovery chamber (11), the receiving reservoir (12) and the throttle is located at the level of the connection between the evacuation line (10) and the decoking line (19).

32. A steam cracking facility according to claim 30, characterized in that it comprises means for isolating the receiving reservoir (12) by means of a valve (13) located at the level of said throttle and means (22) for evacuating the particles contained in the reservoir (12).

33. A steam cracking facility according to claim 25, characterized in that it comprises means (24) for increasing the volume flow rate of the cracked gases in the transfer line exchanger, at the instant of particle injection, said means (24) being connected to the pyrolysis tubes or upstream thereof.

34. A steam cracking facility according to claim 25, comprising means (7) for dosing and injecting coke particles connected to the transfer zone (3), and means (S, 11) for gas/solid separation supplied by the effluents from the transfer line exchanger (4), characterized in that it also comprises means for discontinuous introduction of a gaseous stream simultaneously with at least some of the injections of coke particles, to perturb the operation of the separation means (S, 11) and provoke the circulation of at least a portion of the injected coke particles towards the downstream means (6).

35. A steam cracking facility according to claim 25, characterized in that it comprises a transfer line exchanger (4) in which 4% to 30% of the tubes for circulation of cracked gases is obstructed.

36. A process according to claim 1, wherein said increase in the temperature at the outlet from the indirect cooling means (4) is maintained to a value of less than 50° C. per month.

37. A process according to claim 1, wherein said intervals in step (b) do not exceed three months.

38. A process according to claim 2, wherein said average amount q of solid particles injected upstream of the cracking zone (2) and/or into said zone is less than 100 ppm with respect to the cracked gases.

39. A process according to claim 2, wherein the average amount of angular, substantially non porous mineral particles is less than 30 ppm with respect to the cracked gases.

40. A process according to claim 12, wherein said injection is conducted discontinuously at fixed or variable intervals in the range of 1 to 20 hours.

41. A process according to claim 14, wherein said instantaneous quantity of particles is in the range of 1% to 10% by weight with respect to the cracked gases.

* * * * *